US010801144B2

(12) United States Patent
Tseng

(10) Patent No.: US 10,801,144 B2
(45) Date of Patent: Oct. 13, 2020

(54) HOLLOW PIPE JOINT STRUCTURE FOR A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 164 days.

(21) Appl. No.: 15/890,753

(22) Filed: Feb. 7, 2018

(65) Prior Publication Data

US 2019/0242046 A1 Aug. 8, 2019

(51) Int. Cl.
*D05B 69/08* (2006.01)
*D05B 69/30* (2006.01)

(52) U.S. Cl.
CPC ..... *D05B 69/08* (2013.01); *D05B 69/30* (2013.01)

(58) Field of Classification Search
CPC ..... D05B 69/00; D05B 69/08; D05B 69/30; D05B 71/00; D05B 71/04; D05B 81/00; D05B 87/00; F16L 13/16; F16L 19/00; F16L 19/02; F16L 19/0206; F16L 19/08; F16L 19/14; F16L 21/005; F16L 21/05; F16L 21/06
See application file for complete search history.

(56) References Cited

U.S. PATENT DOCUMENTS 927,635 A * 7/1909 Calvert ..... A61B 18/1485 604/101.05
2,446,261 A * 8/1948 Christensen ..... D05B 3/06 112/281
2,455,544 A * 12/1948 Yonkers ..... F16L 21/005 285/7
2,483,037 A * 9/1949 Christensen ..... D05B 71/04 112/281
2,702,716 A * 2/1955 Basolo ..... F16L 21/022 285/322
3,100,658 A * 8/1963 Miller ..... F16L 13/10 285/230
3,483,836 A * 12/1969 Meersand ..... D05B 71/04 112/281
3,653,691 A * 4/1972 Bram ..... F16L 19/061 285/236
3,805,337 A * 4/1974 Branstetter ..... F16L 33/03 24/27
3,884,508 A * 5/1975 Jones ..... F16L 37/0844 285/31
4,545,312 A * 10/1985 Ingram ..... D05C 15/20 112/256
4,634,201 A * 1/1987 Kemka ..... H01R 4/01 439/161
4,928,610 A * 5/1990 Akutsu ..... D05B 35/10 112/151
5,195,788 A * 3/1993 Oetiker ..... B21D 39/046 285/252
5,338,070 A * 8/1994 Horikawa ..... F16L 13/004 285/148.23

(Continued)

*Primary Examiner* — Ismael Izaguirre
(74) *Attorney, Agent, or Firm* — Wang Law Firm, Inc.

(57) ABSTRACT

A hollow pipe joint structure for a sewing machine includes a first hollow pipe, a second hollow pipe and an elastic member. The elastic member is sleeved onto the first hollow pipe and the second hollow pipe, and elastically squeezes against the first outer surface and the second outer surface of the first and second hollow pipes, respectively, to pull the first and second hollow pipes against each other, which makes assembly of the hollow pipes easier, quicker and no frequent maintenance is required.

5 Claims, 14 Drawing Sheets

(56) References Cited

U.S. PATENT DOCUMENTS

| | | | | |
|---|---|---|---|---|
| 6,238,392 | B1 * | 5/2001 | Long | A61B 18/1485<br>604/101.05 |
| 6,779,269 | B2 * | 8/2004 | Green | F16L 35/00<br>285/114 |
| 9,249,912 | B2 * | 2/2016 | Flynn | F16L 33/22 |

* cited by examiner

HOLLOW PIPE JOINT STRUCTURE FOR A SEWING MACHINE

BACKGROUND

Field of the Invention

The present invention relates to a sewing machine, and more particularly to a hollow pipe joint structure for a sewing machine.

Related Prior Art

Sewing machines are complicated products equipped with a hollow pipe assembly for supply gas. The hollow pipe assembly is typically made up of two hollow pipes jointed to each other by soldering. However, the foregoing soldering method has many inconveniences, which are described as follows:

First of all, the diameter of the hollow pipes of the sewing machine is very small, therefore, soldering the hollow pipes is inconvenient, time-consuming and laborious. Besides, it is easy to cause gas leakage in the pipes due to incomplete soldering and result in failure of the sewing machine.

On the other hand, the sewing machine will produce high frequency vibration during use, and after a certain time, the solder at the soldering point between the two hollow pipes is very likely to fall off, causing increase in maintenance costs.

The present invention has arisen to mitigate and/or obviate the afore-described disadvantages.

SUMMARY

One objective of the present invention is to provide a hollow pipe joint structure for a sewing machine capable of allowing hollow pipes to be jointed tightly without gas leakage.

Another objective of the present invention is to provide a hollow pipe joint structure for a sewing machine capable of making assembly of the hollow pipes easier and quicker.

Yet another objective of the present invention is to provide a hollow pipe joint structure for a sewing machine capable of maintaining the structure strength of the hollow pipe joint structure for a long period of time, without requiring frequent maintenance.

To achieve the above objectives, a hollow pipe joint structure for a sewing machine in accordance with the present invention, comprises:

a first hollow pipe including a first insertion hole and a first outer surface;

a second hollow pipe including a second insertion hole and a second outer surface, wherein the first hollow pipe is inserted in the second insertion hole to connect the first insertion hole to the second insertion hole; and an elastic member sleeved onto the first hollow pipe and the second hollow pipe to elastically squeeze against the first outer surface and the second outer surface, so that the first and second hollow pipes are elastically positioned against each other.

Preferably, the second insertion hole has a first insertion-hole section and a second insertion-hole section, the first hollow pipe is inserted in the first insertion-hole section, the first insertion-hole section has a first inner diameter, the second insertion-hole section has a second inner diameter, and the first inner diameter is larger than the second inner diameter.

Preferably, a stepped surface is connected between the first insertion-hole section and the second insertion-hole section, and the first hollow pipe has an end surface inserted in the first insertion-hole section and pressed against the stepped surface.

Preferably, the first hollow pipe has a first outer diameter which is equal to the first inner diameter.

It can be learned from the above description that the elastic member is sleeved onto the first hollow pipe and the second hollow pipe, and elastically squeezes against the first outer surface and the second outer surface to pull the first and second hollow pipes against each other, which makes assembly of the hollow pipes easier, quicker and no frequent maintenance is required.

Furthermore, in a preferred embodiment of the invention, the first outer diameter of the first hollow pipe is equal to the first inner diameter of the second hollow pipe, so that the second outer surface of the second hollow pipe can fit tightly against the inner surface of the first insertion hole, and the hollow pipes can be jointed in an airtight manner to prevent gas leakage.

Moreover, in another preferred embodiment of the invention, the elastic member elastically squeezes against the first hollow pipe and the second hollow pipe to make the end surface press tightly against the stepped surface, so that the hollow pipes can be jointed in an airtight manner to prevent gas leakage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
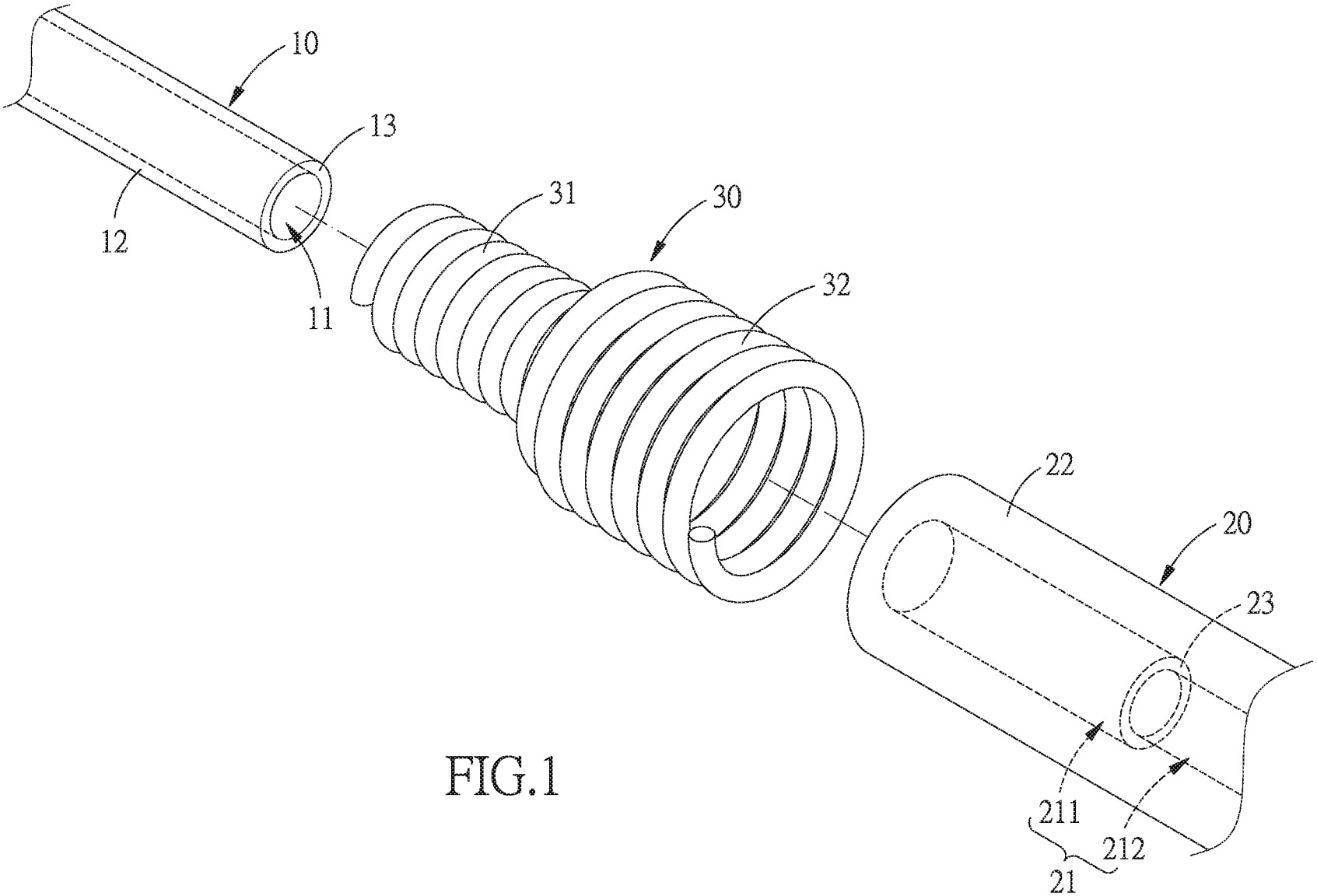
FIG. 1 is an exploded view of a hollow pipe joint structure for a sewing machine in accordance with a first embodiment of the invention.
Figure 2:
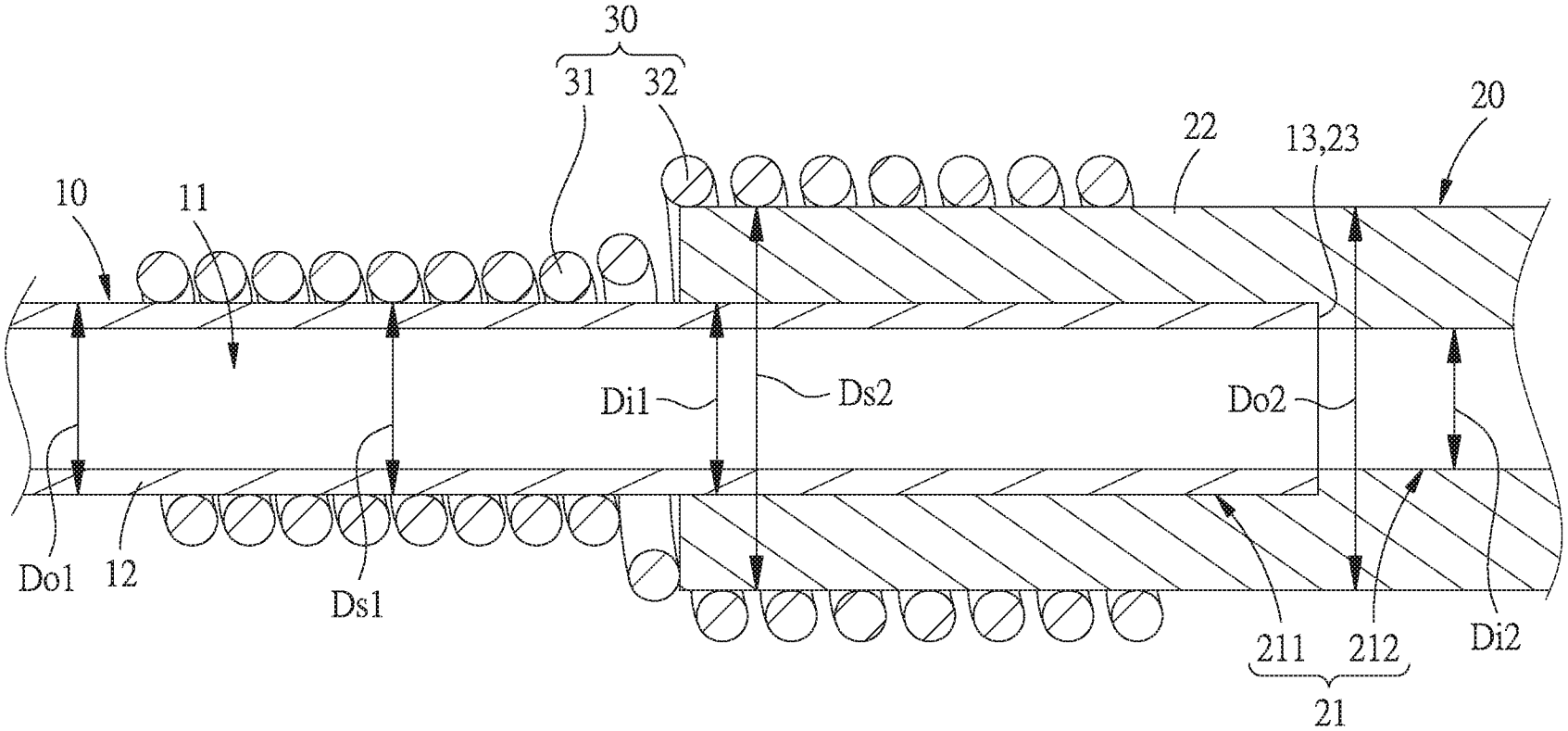
FIG. 2 is a cross sectional view of the hollow pipe joint structure for a sewing machine in accordance with the first embodiment of the invention.

Referring to FIGS. 1 and 2, a hollow pipe joint structure for a sewing machine in accordance with the first embodiment of the invention comprises: a first hollow pipe 10, a second hollow pipe 20 and an elastic member 30.

The first hollow pipe 10 includes a first insertion hole 11. An outer surface of the first hollow pipe 10 is defined as a first outer surface 12, and a diameter of the first hollow pipe 10 is defined as a first outer diameter Do1.

The second hollow pipe 20 includes a second insertion hole 21 which has a first insertion-hole section 211 and a second insertion-hole section 212. The first hollow pipe 10 is inserted in the first insertion-hole section 211 to connect the first insertion hole 11 to the second insertion hole 21. An outer surface of the second hollow pipe 20 is defined as a second outer surface 22, and a diameter of the second hollow pipe 20 is defined as a second outer diameter Do2. An inner diameter of the first insertion-hole section 211 is defined as a first inner diameter Di1, an inner diameter of the second insertion-hole section 212 is defined as a second inner diameter Di2, and the first inner diameter Di1 is larger than the second inner diameter Di2.

The elastic member 30 is sleeved onto the first hollow pipe 10 and the second hollow pipe 20, and elastically squeezes against the first outer surface 12 and the second outer surface 22 to make the first and second hollow pipes 10, 20 approach each other. The elastic member 30 includes a first elastic section 31 elastically squeezing against the first outer surface 12 and a second elastic section 32 elastically squeezing against the second outer surface 22. An inner diameter of the first elastic section 31 is defined as a first elastic-member inner diameter Ds1, and an inner diameter of the second elastic section 32 is defined as a second elastic-member inner diameter Ds2.

In this embodiment, the second outer diameter Do2 is larger than the first outer diameter Do1, and the second elastic-member inner diameter Ds2 is larger than the first elastic-member inner diameter Ds1.

Figure 3:
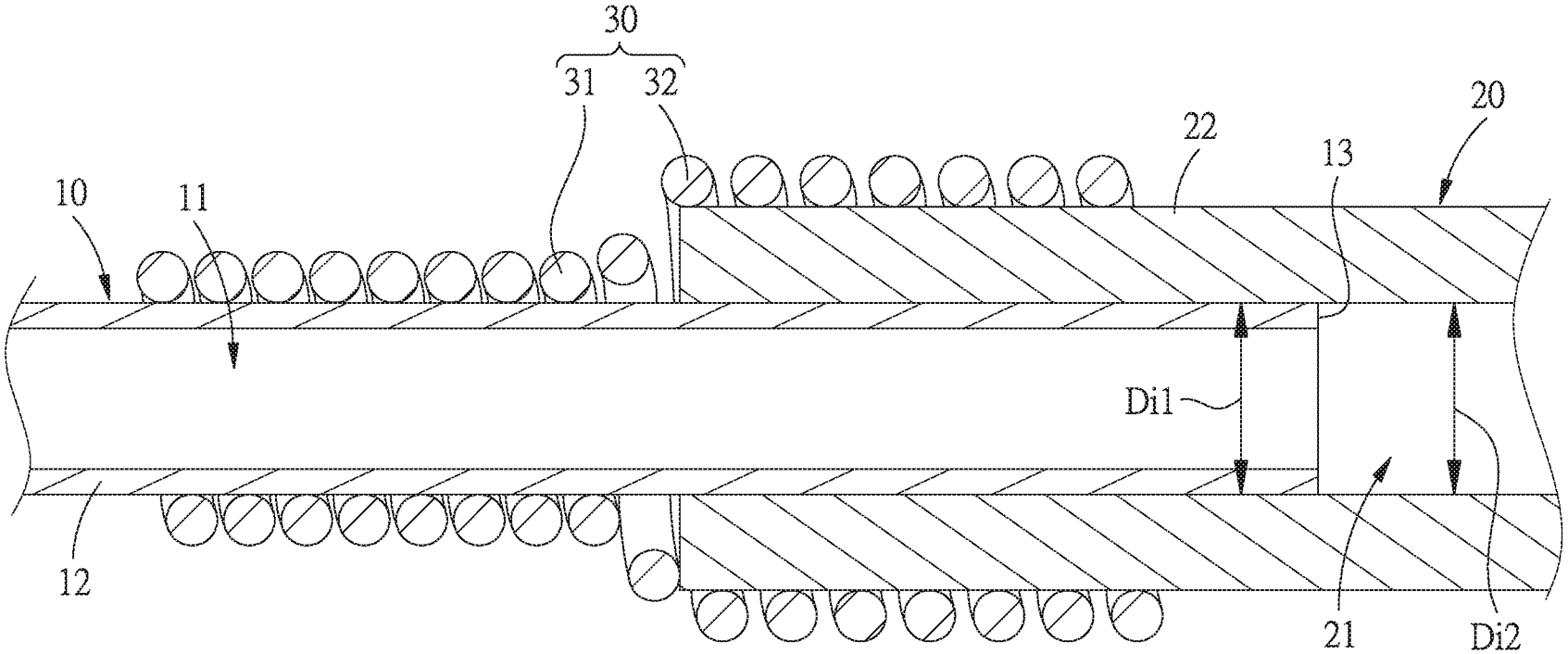
FIG. 3 is a cross sectional view of the hollow pipe joint structure for a sewing machine in accordance with a preferred embodiment of the invention.

In a preferred embodiment as shown in FIG. 3, the first inner diameter Di1 is equal to the second inner diameter Di2.

Figure 14:
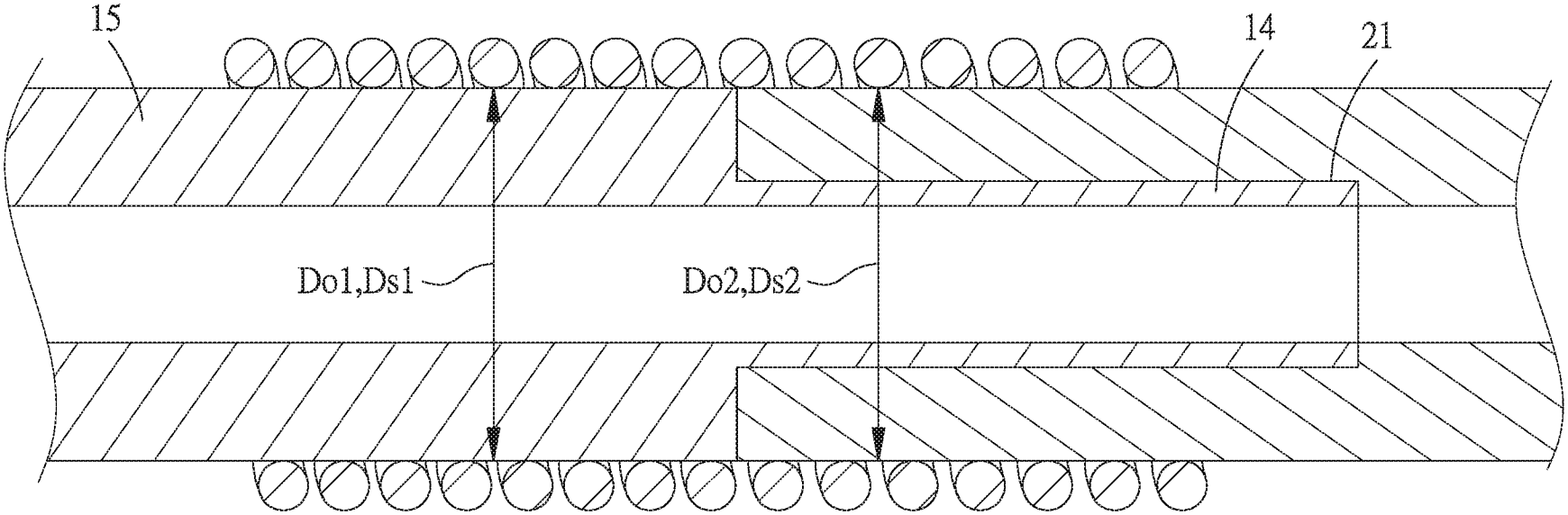
FIG. 14 is a cross sectional view of the hollow pipe joint structure for a sewing machine in accordance with a second embodiment of the invention.

The second embodiment of the invention as shown in FIG. 14 is similar to the first embodiment, except that:

The first hollow pipe 10 includes an insertion section 14 and an exposed section 15 connected to the insertion section 14, and the exposed section 15 has the first outer diameter Do1 equal to the second outer diameter Do2. The second elastic-member inner diameter Ds2 is equal to the first elastic-member inner diameter Ds1. The insertion section 14 has a diameter smaller than the first outer diameter Do1, and is inserted in the second insertion hole 21.

In the first embodiment shown in FIGS. 1 and 2, a stepped surface 23 is connected between the first insertion-hole section 211 and the second insertion-hole section 212. The first hollow pipe 10 has an end surface 13 inserted in the first insertion-hole section 211 and pressed against the stepped surface 23 to prevent gas leakage from the first and second hollow pipes 10, 20.

In the first embodiment shown in FIGS. 1 and 2, the first outer diameter Do1 of the first hollow pipe 10 is equal to the first inner diameter Di1 of the second hollow pipe 20, so as to prevent gas leakage from the first and second hollow pipes 10, 20.

Before the elastic member 30 is sleeved onto the first and second hollow pipes 10, 20, the first outer diameter Do1 is larger than the first elastic-member inner diameter Ds1, and the second outer diameter Do2 is larger than the second elastic-member inner diameter Ds2.

When the elastic member 30 is sleeved onto the first and second hollow pipes 10, 20, the first outer diameter Do1 will be equal to the first elastic-member inner diameter Ds1, and the second outer diameter Do2 will be equal to the second elastic-member inner diameter Ds2.

Figure 4:
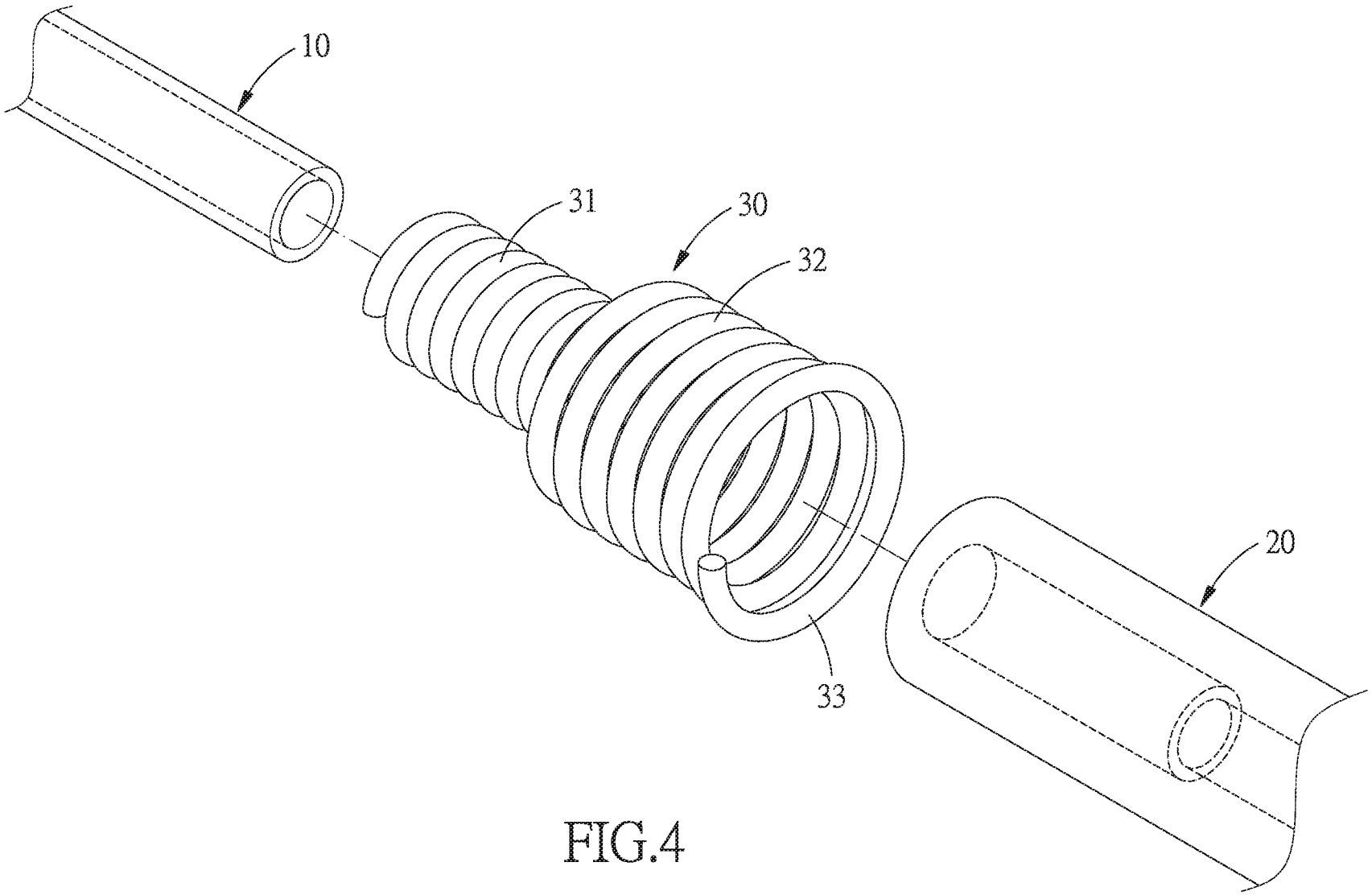
FIG. 4 is an exploded view of the hollow pipe joint structure for a sewing machine in accordance with a preferred embodiment of the invention.
Figure 5:
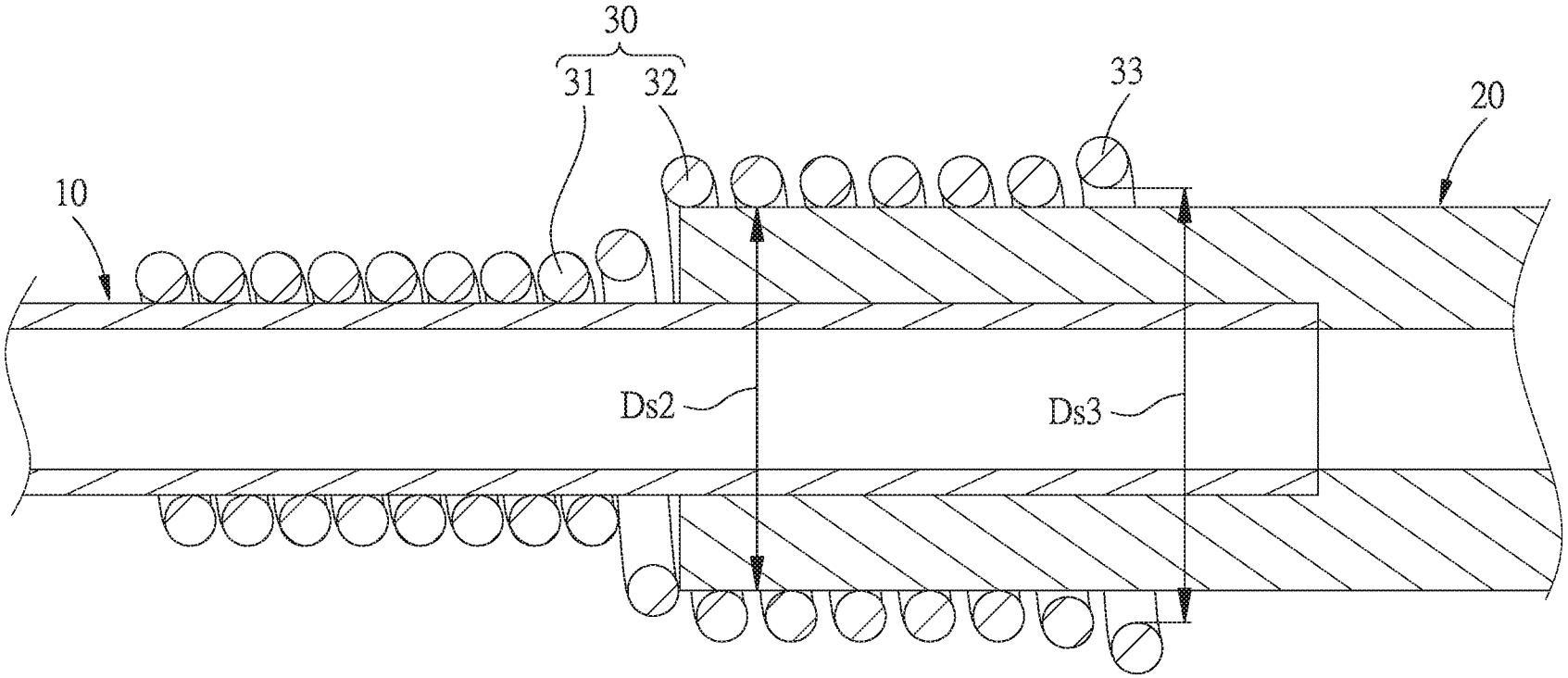
FIG. 5 is a cross sectional view of the hollow pipe joint structure for a sewing machine in accordance with the preferred embodiment of the invention.

In the preferred embodiment shown in FIGS. 4 and 5, the second elastic section 32 has one end connected to the first elastic section 31, and the elastic member 30 includes a third elastic section 33 connected to another end of the second elastic section 32 opposite to the end connected to the first elastic section 31. An inner diameter of the third elastic section 33 is defined as a third elastic-member inner diameter Ds3 which is larger than the second elastic-member inner diameter Ds2.

Figure 6:
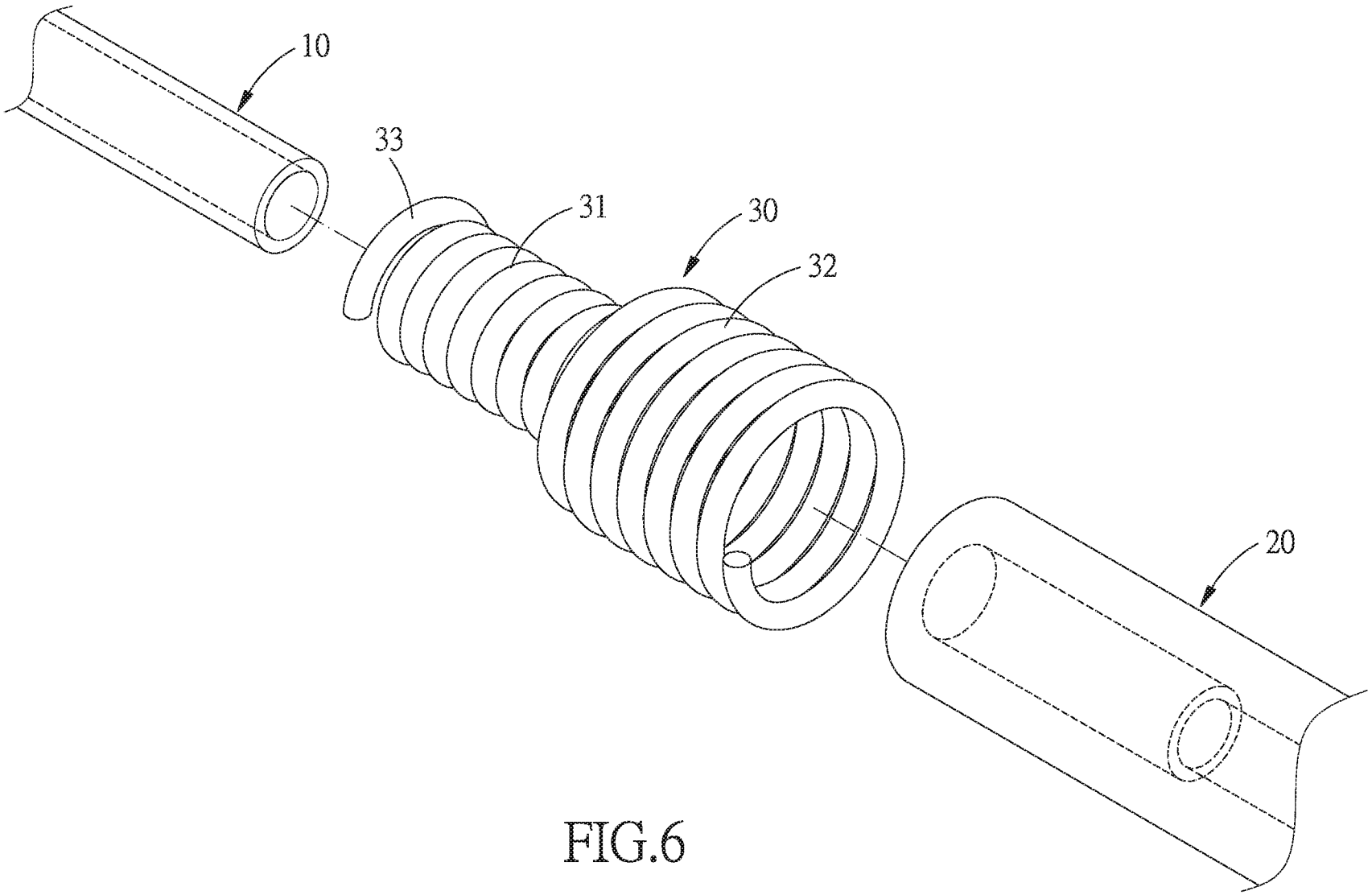
FIG. 6 is an exploded view of the hollow pipe joint structure for a sewing machine in accordance with another preferred embodiment of the invention.
Figure 7:
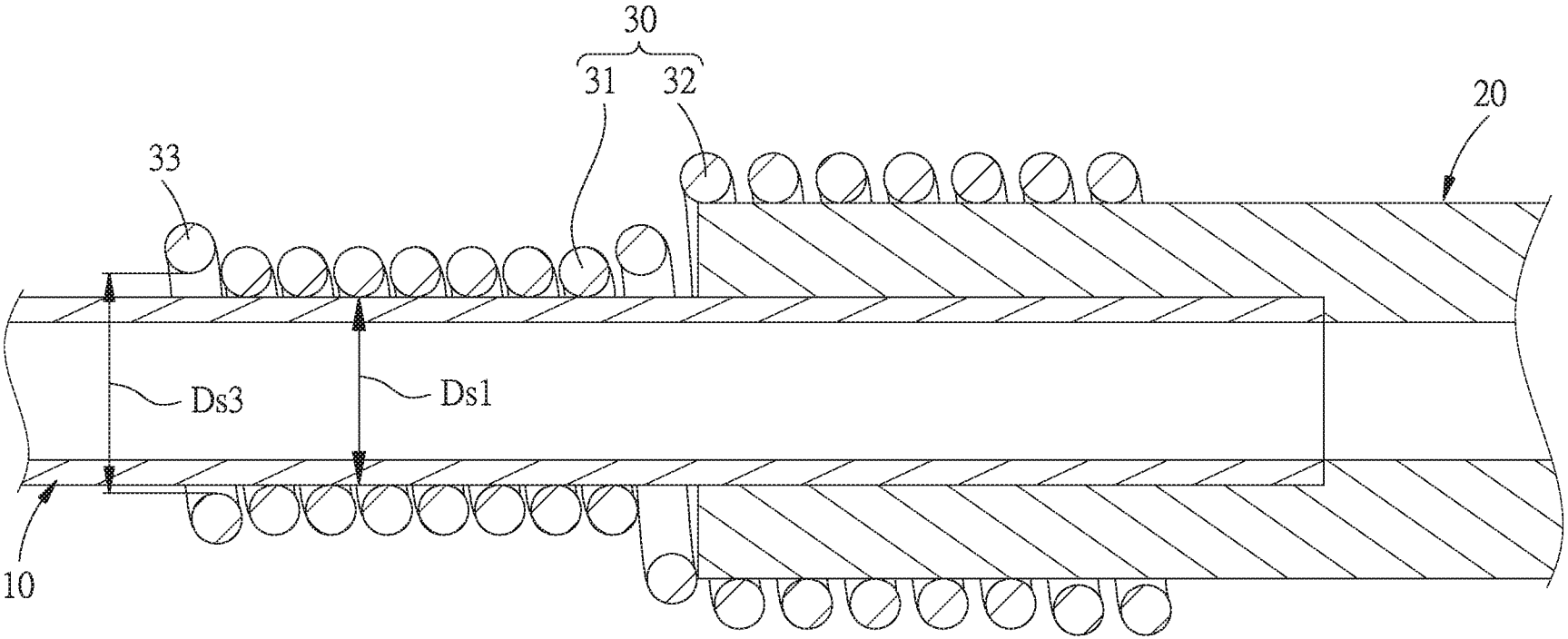
FIG. 7 is a cross sectional view of the hollow pipe joint structure for a sewing machine in accordance with the another preferred embodiment of the invention.

In a preferred embodiment as shown in FIGS. 6 and 7, the first elastic section 31 has one end connected to the second elastic section 32, and the elastic member 30 includes a third elastic section 33 connected to another end of the first elastic section 31 opposite to the end connected to the second elastic section 32. The third elastic-member inner diameter Ds3 of the third elastic section 33 is larger than the first elastic-member inner diameter Ds1.

Figure 8:
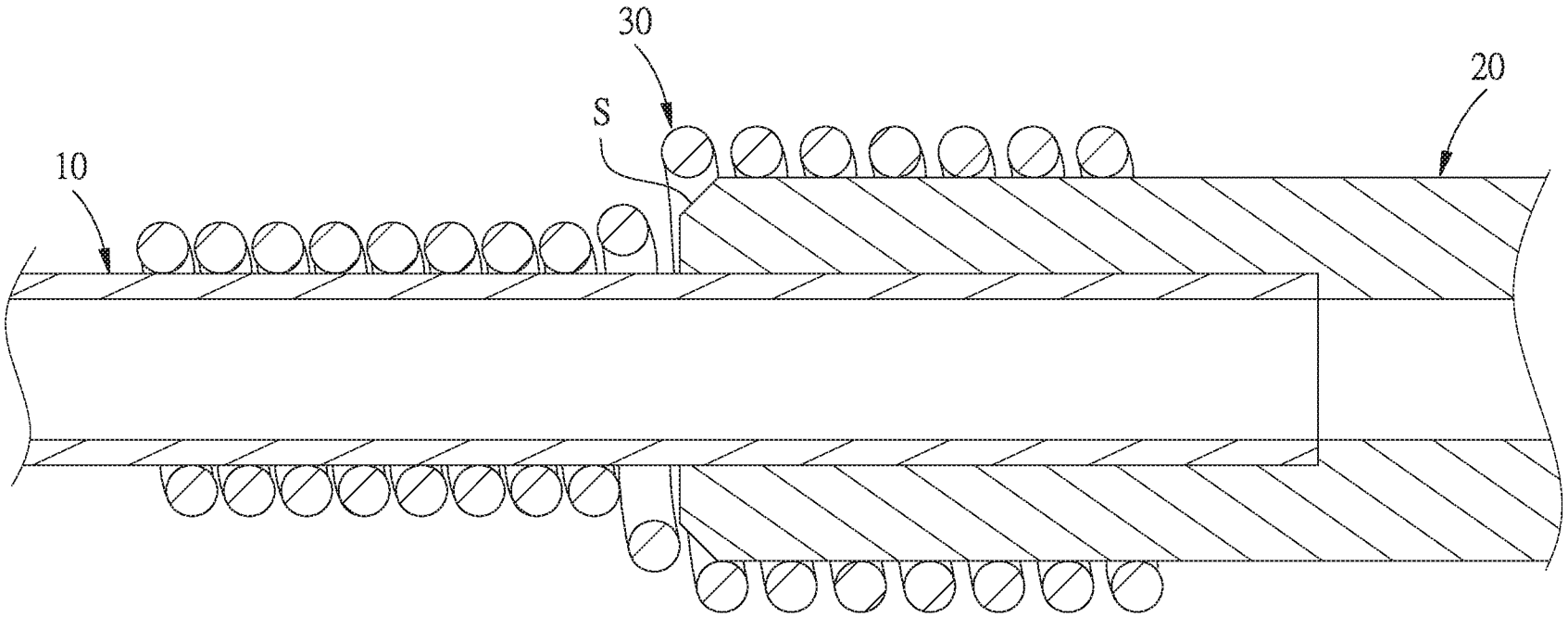
FIG. 8 is a cross sectional view of the hollow pipe joint structure for a sewing machine in accordance with another preferred embodiment of the invention.

In the preferred embodiment as shown in FIG. 8, one end of the second hollow pipe 20 connected to the first hollow pipe 10 is provided with a guide angle portion S to allow the elastic member 30 to be sleeved onto the second hollow pipe 20 more easily and smoothly.

Figure 9:
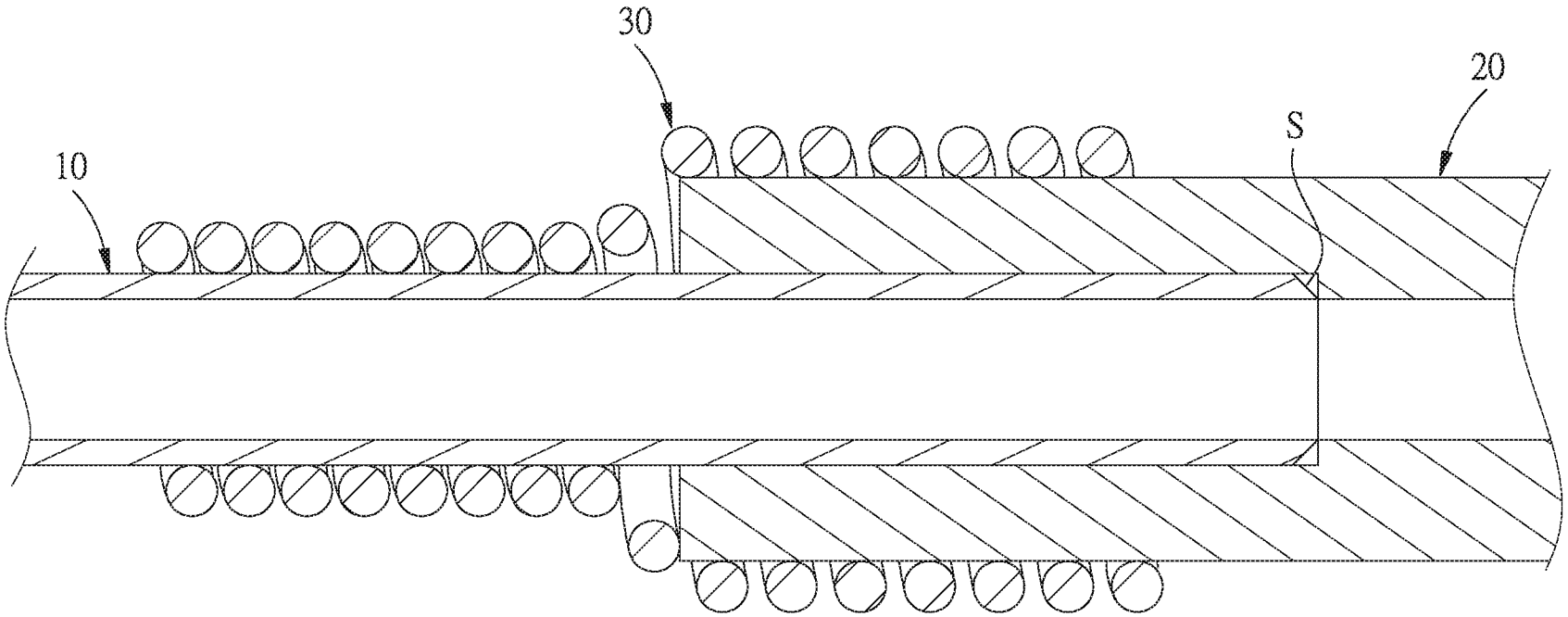
FIG. 9 is a cross sectional view of the hollow pipe joint structure for a sewing machine in accordance with another preferred embodiment of the invention.

In a preferred embodiment as shown FIG. 9, one end of the first hollow pipe 10 connected to the second hollow pipe 20 is provided with the guide angle portion S to allow the elastic member 30 to be sleeved onto the first hollow pipe 10 more smoothly and easily.

Figure 10:
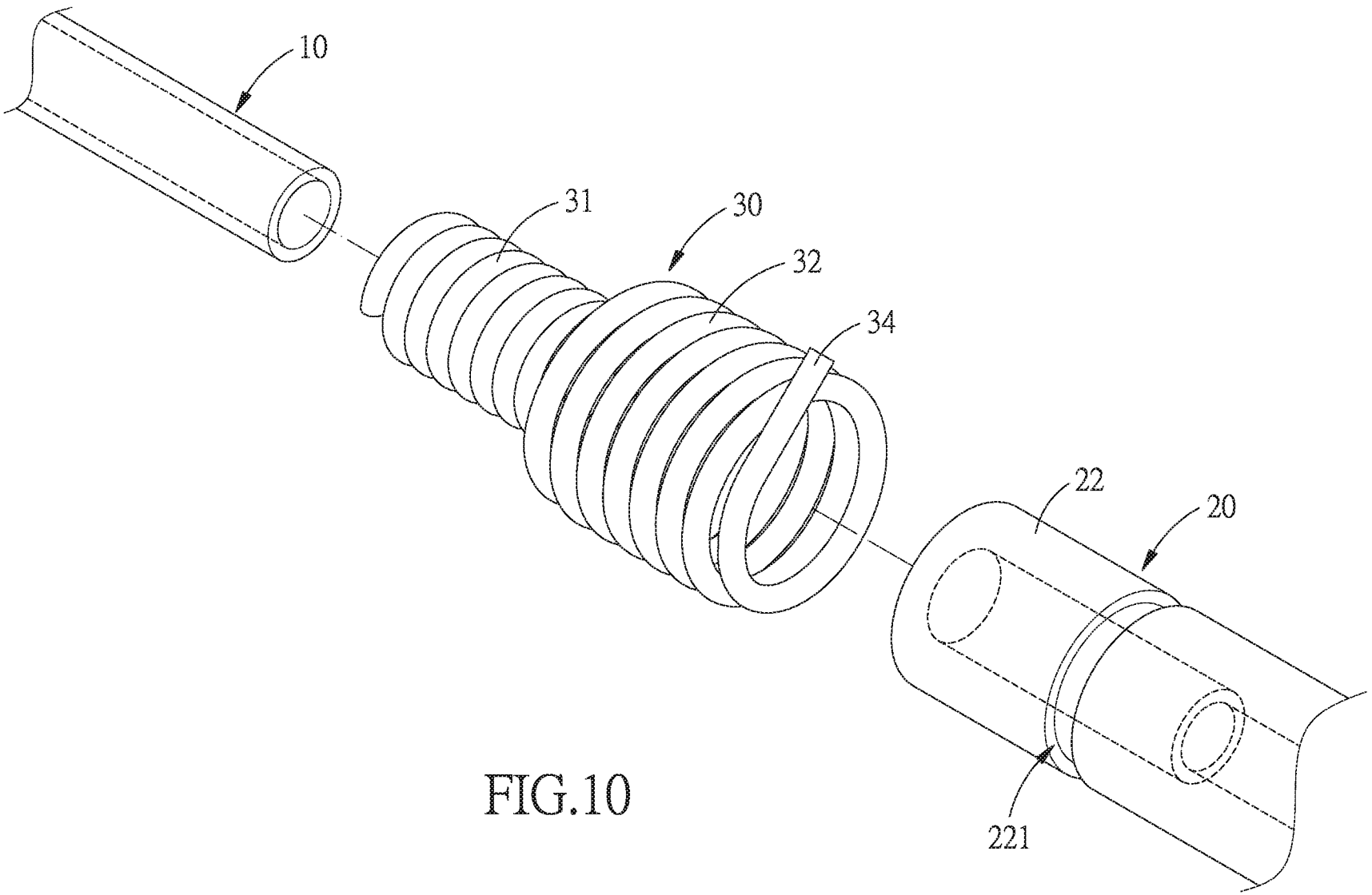
FIG. 10 is an exploded view of the hollow pipe joint structure for a sewing machine in accordance with a preferred embodiment of the invention.
Figure 11:
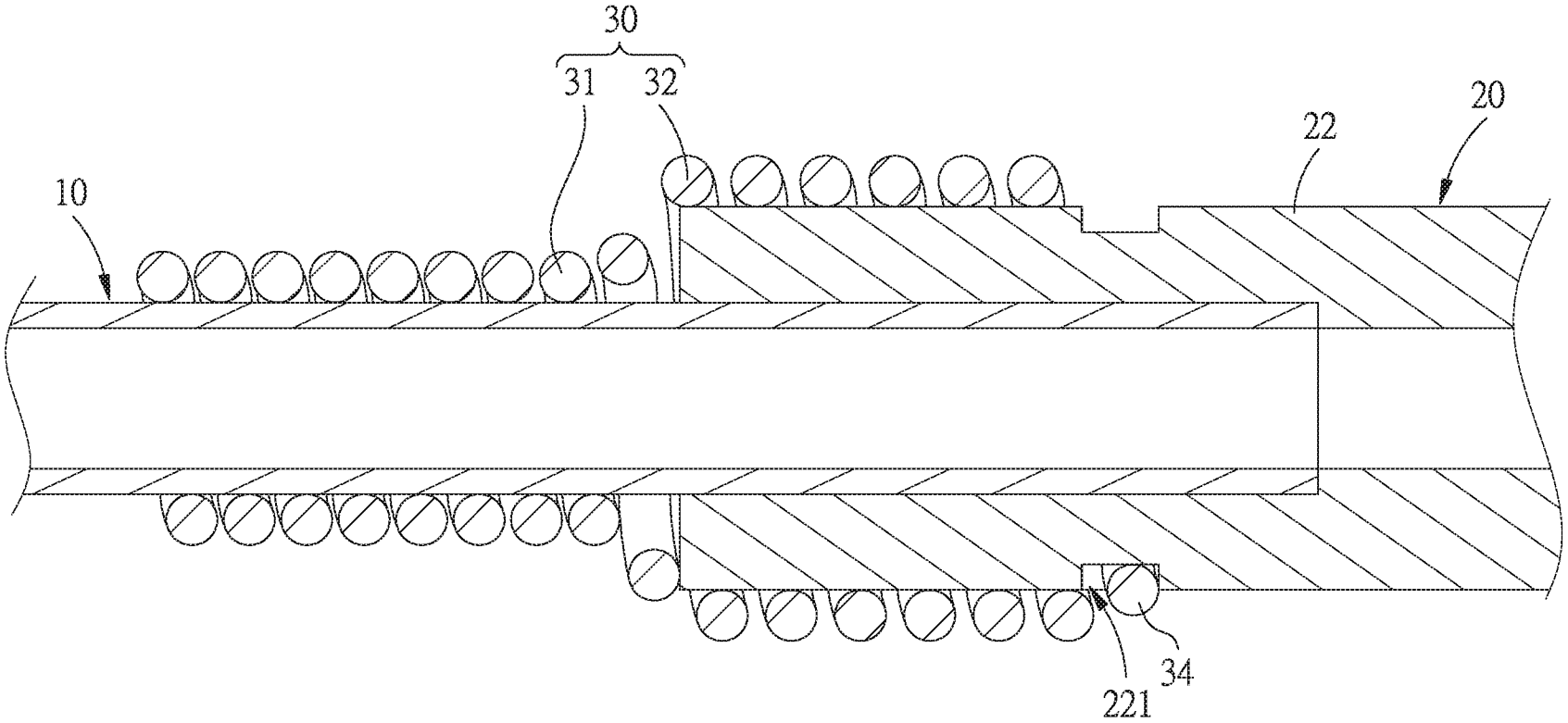
FIG. 11 is a cross sectional view of the hollow pipe joint structure for a sewing machine in accordance with another preferred embodiment of the invention.

In the preferred embodiment as shown in FIGS. 10 and 11, the second elastic section 32 has one end connected to the first elastic section 31, and another end of the second elastic section 32 opposite to the one end connected to the first elastic section 31 is provided with a retaining portion 34. The second hollow pipe 20 is provided with a retaining groove 221 in the second outer surface 22. When the elastic member 30 is sleeved onto the second hollow pipe 20, the retaining portion 34 is engaged in the retaining groove 221 to stop the elastic member 30 from sliding off the second outer surface 22. A diameter defined by the retaining portion 34 is smaller than the second outer diameter Do2, and the retaining portion 34 can be helical or straight.

Figure 12:
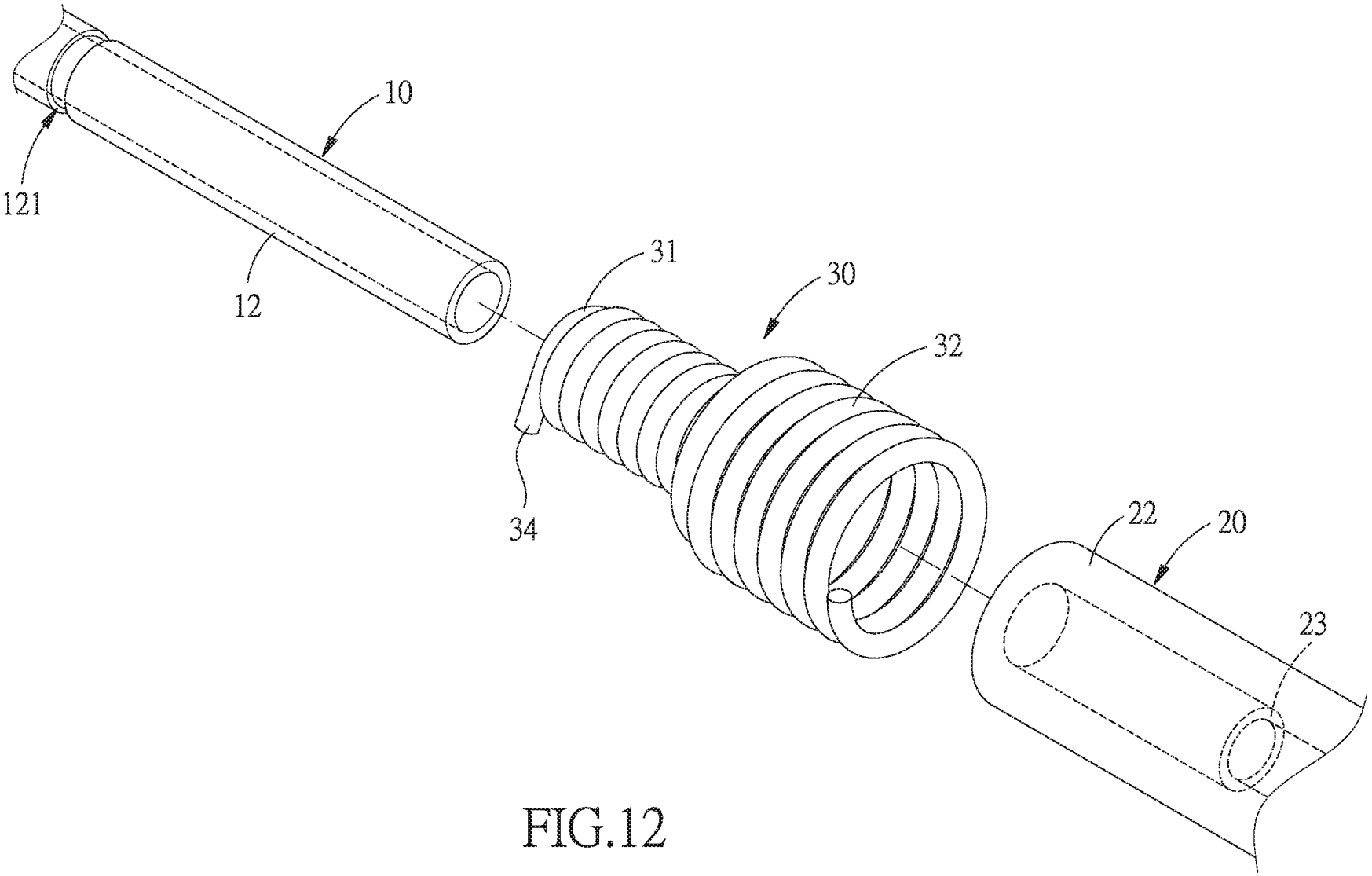
FIG. 12 is an exploded view of the hollow pipe joint structure for a sewing machine in accordance with a preferred embodiment of the invention.
Figure 13:
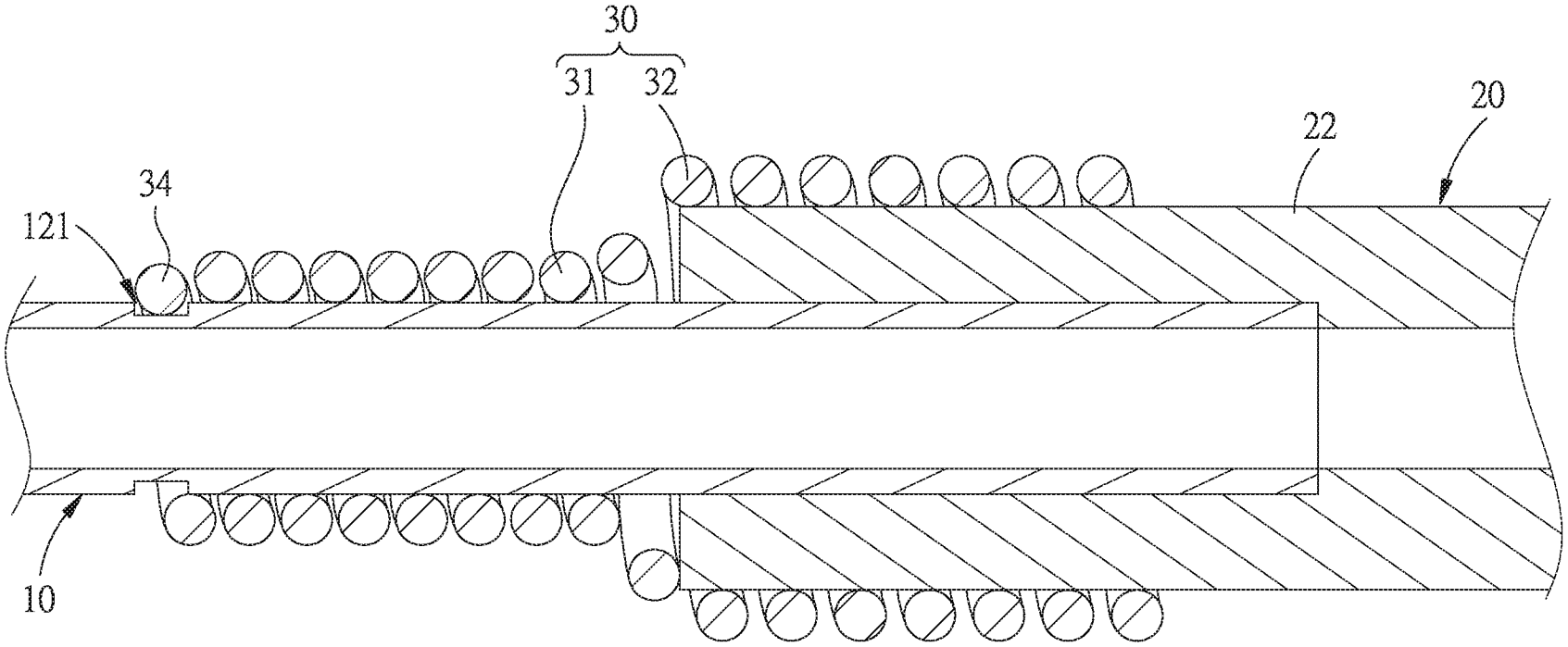
FIG. 13 is a cross sectional view of the hollow pipe joint structure for a sewing machine in accordance with another preferred embodiment of the invention.

In a preferred embodiment as shown in FIGS. 12 and 13, the first elastic section 31 has one end connected to the second elastic section 32, and another end of the first elastic section 31 opposite to the one end connected to the second elastic section 32 is provided with the retaining portion 34. The first hollow pipe 10 is provided with the retaining groove 121 in the first outer surface 12. When the elastic member 30 is sleeved onto the first hollow pipe 10, the retaining portion 34 is engaged in the retaining groove 121 to stop the elastic member 30 from sliding off the first outer surface 12. A diameter defined by the retaining portion 34 is smaller than the first outer diameter Do1, and the retaining portion 34 can be helical or straight.

It can be learned from the above description that the elastic member 30 is sleeved onto the first hollow pipe 10 and the second hollow pipe 20, and elastically squeezes against the first outer surface 12 and the second outer surface 22 to pull the first and second hollow pipes 10, 20 against each other, which makes assembly of the hollow pipes easier, quicker and no frequent maintenance is required.

Furthermore, in a preferred embodiment of the invention, the first outer diameter Do1 of the first hollow pipe 10 is equal to the first inner diameter Di1 of the second hollow pipe 20, so that the second outer surface 22 of the second hollow pipe 20 can fit tightly against the inner surface of the first insertion hole 11, and the hollow pipes can be jointed in an airtight manner to prevent gas leakage.

Moreover, in another preferred embodiment of the invention, the elastic member 30 elastically squeezes against the first hollow pipe 10 and the second hollow pipe 20 to make the end surface 13 press tightly against the stepped surface 23, so that the hollow pipes can be jointed in an airtight manner to prevent gas leakage.

While we have shown and described various embodiments in accordance with the present invention, it is clear to those skilled in the art that further embodiments may be made without departing from the scope of the present invention.

What is claimed is:

1. A hollow pipe joint structure for a sewing machine, comprising:

a first hollow pipe including a first insertion hole and a first outer surface;

a second hollow pipe including a second insertion hole and a second outer surface, wherein the first hollow pipe is inserted in the second insertion hole to connect the first insertion hole to the second insertion hole; and an elastic member sleeved onto the first hollow pipe and the second hollow pipe to elastically squeeze against the first outer surface and the second outer surface;

wherein the elastic member includes a first elastic section elastically squeezing against the first outer surface, and a second elastic section elastically squeezing against the second outer surface, the first hollow pipe includes an insertion section and an exposed section connected to the insertion section, the exposed section has a first outer diameter, the second hollow pipe has a second outer diameter equal to the first outer diameter, the first elastic section has a first elastic-member inner diameter, the second elastic section has a second elastic-member inner diameter, the second elastic-member inner diameter is equal to the first elastic-member inner diameter, the insertion section has a diameter smaller than the first outer diameter and is inserted in the second insertion hole.

2. The hollow pipe joint structure as claimed in claim 1, wherein the second elastic section has one end connected to the first elastic section, the elastic member includes a third elastic section connected to another end of the second elastic section opposite to the one end connected to the first elastic section, the second elastic section has a second elastic-member inner diameter, and the third elastic section has a third elastic-member inner diameter which is larger than the second elastic-member inner diameter.

3. The hollow pipe joint structure as claimed in claim 1, wherein the first elastic section has one end connected to the second elastic section, the elastic member includes a third elastic section connected to another end of the first elastic section opposite to the end connected to the second elastic section, the first elastic section has a first elastic-member inner diameter, and the third elastic section has a third elastic-member inner diameter which is larger than the first elastic-member inner diameter.

4. The hollow pipe joint structure as claimed in claim 1, wherein the second hollow pipe has a second outer diameter, the second elastic section has one end connected to the first elastic section, another end of the second elastic section opposite to the one end connected to the first elastic section is provided with a retaining portion, the second hollow pipe is provided with a retaining groove in the second outer surface, when the elastic member is sleeved onto the second hollow pipe, the retaining portion is engaged in the retaining groove, and a diameter defined by the retaining portion is smaller than the second outer diameter.

5. The hollow pipe joint structure as claimed in claim 1, wherein the first hollow pipe has a first outer diameter, the first elastic section has one end connected to the second elastic section, another end of the first elastic section opposite to the one end connected to the second elastic section is provided with a retaining portion, the first hollow pipe is provided with a retaining groove in the first outer surface, when the elastic member is sleeved onto the first hollow pipe, the retaining portion is engaged in the retaining groove, and a diameter defined by the retaining portion is smaller than the first outer diameter.

* * * * *